US005612015A

United States Patent [19]

Yamamoto et al.

[11] Patent Number: 5,612,015

[45] Date of Patent: Mar. 18, 1997

[54] CARBON FIBERS AND PROCESS FOR THEIR PRODUCTION

[75] Inventors: Iwao Yamamoto; Hiroyuki Aikyo, both of Yokohama, Japan

[73] Assignee: Mitsubishi Chemical Corporation, Tokyo, Japan

[21] Appl. No.: 322,376

[22] Filed: Oct. 13, 1994

Related U.S. Application Data

[63] Continuation of Ser. No. 992,008, Dec. 17, 1992, abandoned.

[30] Foreign Application Priority Data

Dec. 18, 1991 [JP] Japan ..... 3-335271

[51] Int. Cl.[6] ..... D01F 9/12

[52] U.S. Cl. ..... 423/447.6; 423/447.1

[58] Field of Search ..... 423/447.1, 447.6

[56] References Cited

U.S. PATENT DOCUMENTS

| | | | |
|---|---|---|---|
| 4,032,430 | 6/1977 | Lewis | 423/447.1 |
| 4,576,811 | 3/1986 | Riggs et al. | 423/447.2 |
| 4,814,121 | 3/1989 | Watanabe | 423/447.1 |
| 4,980,250 | 12/1990 | Takahashi et al. | 429/194 |
| 5,217,657 | 6/1993 | Engle | 423/447.4 |
| 5,266,294 | 11/1993 | Schulz et al. | 423/447.1 |

FOREIGN PATENT DOCUMENTS

| | | | |
|---|---|---|---|
| 2141285 | 3/1973 | Germany . | |
| 62-45724 | 2/1987 | Japan | 423/447.1 |
| 963195 | 7/1964 | United Kingdom . | |

*Primary Examiner*—Gary P. Straub
*Assistant Examiner*—Stuart L. Hendrickson
*Attorney, Agent, or Firm*—Oblon, Spivak, McClelland, Maier & Neustadt, P.C.

[57] ABSTRACT

A carbon fiber which, when baked at a temperature of at least 3,000° C., will have a spread La of graphite crystallites in the layer plane direction of more than 1,000Å, an electrical specific resistance of less than 1.1 μΩm and a thermal conductivity of more than 1,100 W/m·K.

1 Claim, 1 Drawing Sheet

CARBON FIBERS AND PROCESS FOR THEIR PRODUCTION

This application is a continuation of application Ser. No. 07/992,008, filed on Dec. 17, 1992, now abandoned.

The present invention relates to carbon fibers and a process for their production. The carbon fibers produced by the present invention exhibit remarkably high thermal conductivity by themselves or, when baked at a super high temperature, will give carbon fibers having remarkably high thermal conductivity. The carbon fibers having such high thermal conductivity are useful as structural materials for space ships for which high levels of dimensional stability and heat shock resistance are required, or as heat dissipation materials for high energy density electronics devices.

High performance carbon fibers are generally classified into PAN-type carbon fibers prepared from polyacrylonitrile (PAN) as starting material and pitch-type carbon fibers prepared from pitches as starting material, and they are widely used as e.g. materials for aircrafts, materials for sporting goods and materials for buildings, by virtue of their characteristics such as high specific strength and high specific modulus elasticity, respectively.

However, for the application as materials for space ships for which dimensional stability and heat shock resistance are required within a wide temperature range and as heat dissipation materials for electronic devices for which high energy densification continues to progress, high thermal conductivity is required in addition to the above-mentioned mechanical properties. Accordingly, many studies have been made to improve the thermal conductivity of carbon fibers. However, the thermal conductivity of commercially available PAN-type carbon fibers is usually lower than 200 W/m·K and its electrical specific resistance is usually higher than 5 μΩm.

On the other hand, with pitch-type carbon fibers, it is usually believed that high thermal conductivity and low electrical specific resistance can readily be accomplished as compared with PAN-type carbon fibers. However, the thermal conductivity of commercially available pitch-type carbon fibers is usually lower than 700 Wm·K, and the electrical specific resistance is usually higher than 1.8 μΩm. Recently, a method has been proposed wherein carbon fibers having a low electrical specific resistance can be produced by prescribing the softening point of pitch, the spinning temperature and the baking temperature (Japanese Unexamined Patent Publication No. 24299/1990). However, carbon fibers having a thermal conductivity higher than 1,100 Wm·K and an electrical specific resistance lower than 1.1 μΩm and a process for their production have not yet been reported.

As described in the foregoing, although carbon fibers having high thermal conductivity and low electrical resistance are being developed, the thermal conductivity is not always sufficient, and carbon fibers having higher thermal conductivity have been desired.

The present inventors have conducted extensive studies with an aim to solve the above problems. As a result, it has been found that when spinning of an optically anisotropic pitch is conducted under a special condition such that the orientation of pitch molecules increases to obtain carbon fibers having very large graphite crystallites, such carbon fibers will have very high electrical conductivity and thermal conductivity. The present invention has been accomplished on the basis of this discovery.

Namely, it is an object of the present invention to provide carbon fibers showing remarkably high electrical conductivity and thermal conductivity as compared with conventional carbon fibers carbonized or graphitized under the same conditions, in an industrially advantageous manner.

Such an object of the present invention can readily be accomplished by:

- a carbon fiber which, when baked at a temperature of at least 3,000° C. will have a spread La of graphite crystallites in the layer plane direction of more than 1,000Å, an electrical specific resistance of less than 1.1 μΩm and a thermal conductivity of more than 1,100 Wm·K;
- a carbon fiber having a spread La of graphite crystallites in the layer plane direction of more than 1,000Å, an electrical specific resistance of less than 1.1 μΩm and a thermal conductivity of more than 1,100 Wm·K, obtained by baking the above carbon fiber at a super high temperature of at least 3,000° C.; and
- a process for producing a carbon fiber which comprises spinning an optically anisotropic pitch at a temperature at which the viscosity of the optically anisotropic pitch would be not higher than 150 poise, by means of a nozzle having an introduction angle of smaller than 70° and ratio (L/D) of the outlet length L to the outlet diameter D of more than 4, to obtain a pitch fiber, and subjecting the pitch fiber to infusible treatment, carbonization, and/or graphitization.

Now, the present invention will be described in detail.

Figure 1:
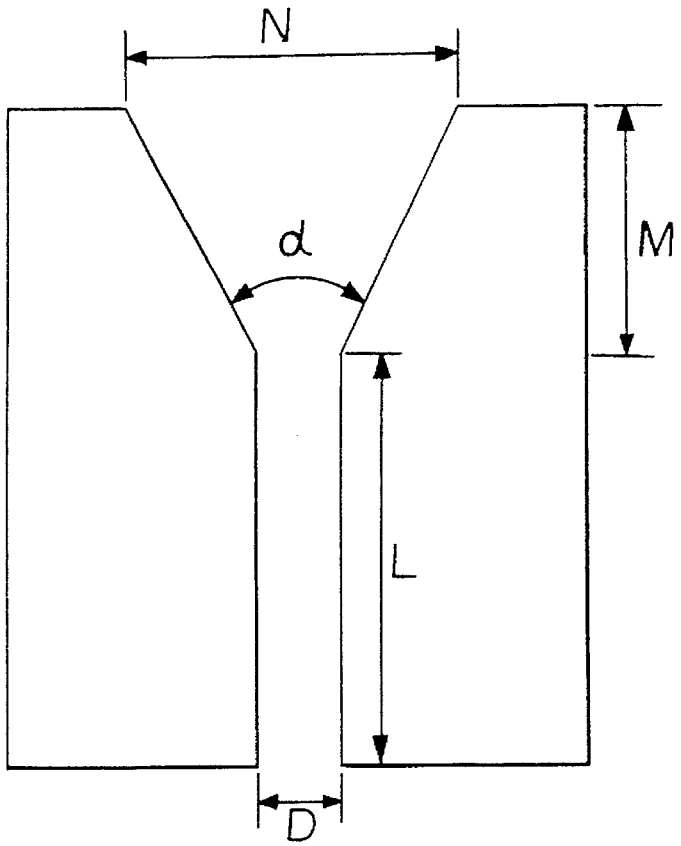
FIG. 1 is a cross sectional view of a spinning nozzle to be used for the process for producing a carbon fiber according to the present invention.

There is no particular restriction as to the spinning pitch to be used for the present invention to obtain the carbon fiber, so long as it is capable of presenting an optically anisotropic carbon fiber and it has readily orientable molecular species formed therein.

The carbonaceous material to obtain such spinning pitch, may, for example, be coal-type coal tar, coal tar pitch, a liquefied product of coal, petroleum-type heavy oil, tar, pitch or a polymerization reaction product of naphthalene or anthracene obtained by a catalytic reaction. These carbonaceous materials contain impurities such as free carbon, unsoluble coal, an ash content and a catalyst. It is advisable to preliminarily remove such impurities by a conventional method such as filtration, centrifugal separation or sedimentation separation by means of a solvent.

Further, the carbonaceous material may be subjected to pretreatment, by e.g. a method wherein after heat treatment, a soluble content is extracted with a certain specific solvent, or a method wherein it is hydrogenated in the presence of a hydrogen donating solvent or hydrogen gas.

In the present invention, it is advisable to employ carbonaceous material which contains at least 40%, preferably at least 70%, more preferably at least 90%, of an optically anisotropic structure. For this purpose, the above-mentioned carbonaceous material may be heat-treated usually at a temperature of from 350° to 500° C., preferably from 380° to 450° C., for from 2 minutes to 50 hours, preferably from 5 minutes to 5 hours, in an atmosphere of an inert gas such as nitrogen, argon or hydrogen, or while blowing such an inert gas, as the case requires.

In the present invention, the proportion of the optically anisotropic structure of pitch is the proportion of the area of the portion showing optical anisotropy in a pitch sample, as observed by polarization microscope at room temperature. Specifically, for example, a pitch sample pulverized to a particle size of a 10 mm is embedded on substantially the entire surface of a resin with a diameter of 2 cm by a conventional method, and the surface is polished. Then, the entire surface is observed under a polarization microscope (100 magnifications), whereby the proportion of the area of the optically anisotropic portion in the entire surface area of the sample is measured.

As a result of various studies conducted prior to the preparation of the carbon fiber having low electrical specific resistance and high thermal conductivity, it has been found that the electrical specific resistance and thermal conductivity of the carbon fiber are governed only by the size of graphite crystallites constituting the carbon fiber. Namely, with the carbon fiber, irrespective of the method for the preparation of the raw material, the larger the graphite crystallites, the less the scattering of electrical and thermal carriers due to lattice defects, and the higher the electrical and thermal conductivities. With this result and taking into consideration the fact that with a carbon fiber, the better the orientation of pitch molecules in the axial direction of the fiber in the stage of the pitch fiber, the larger the graphite crystallites of the carbon fiber tends to become in the subsequent carbonization step, the present inventors have reached a conclusion that in order to increase the electrical conductivity and thermal conductivity of a carbon fiber, it is important to prepare a pitch fiber having good orientation in the spinning step.

In the present invention, it is essential to improve the orientation of pitch molecules by increasing the shearing force exerted on pitch molecules from the inner wall of a nozzle by adjusting the introduction angle $\alpha$ of the nozzle at a level smaller than 70° as shown in FIG. 1 and the ratio (L/D) of the outlet length L to the outlet diameter D at a level of more than 4 and to conduct spinning of the pitch fiber from the above pitch, at a temperature at which the viscosity of the spinning pitch at the outlet would be not higher than 150 poise to minimize the disturbance of the orientation due to stretching, to prepare a pitch fiber having excellent orientation.

More preferably, the ratio (L/D) of the outlet length L to the outlet diameter D is not higher than 100. If the ratio L/D exceeds 100, the pressure exerted on the nozzle will be high, whereby the weight of the spinneret increases, and a further problem is likely to result such that due to heat dissipation, a change will occur in the viscosity of the raw material pitch. The length M of the opening is preferably larger than at least the outlet diameter L. If M is smaller than L, the effect of the introduction angle of the nozzle tends to be small. The introduction angle $\alpha$ of the nozzle is preferably at least 10°. If $\alpha$ is too small, it tends to be difficult to obtain the effect of the present invention. The diameter N of the opening of the nozzle is not particularly limited from the technical point of view. However, from the relation with the adjacent nozzle, it is preferably not more than 20 mm. Spinning of carbon fibers is usually conducted by means of a spinneret having many spinning nozzles. Accordingly, if N is too large, the spinneret is obliged to be large, such being practically undesirable. The size of the outlet diameter D is not particularly limited, but is preferably from 0.05 mm to 1 mm.

The pitch fiber obtained by using such a nozzle, is subjected to infusible treatment by a conventional method, followed by carbonization and/or graphitization at an optional temperature, whereby it is possible to obtain a carbon fiber having high electrical conductivity and thermal conductivity with large graphite crystallites. Here, the higher the carbonization and graphitization temperatures, or the longer the time for the carbonization and graphitization, the larger the graphite crystallites grow, whereby a carbon fiber having high electrical conductivity and thermal conductivity will be obtained. The size of graphite crystallites can be evaluated in terms of the spread La of the graphite crystallites in the layer plane direction.

The carbon fiber of the present invention has a feature that when it is baked at a temperature of at least 3,000° C., the spread La of graphite crystallites in the layer plane direction will be more than 1,000Å.

In the present invention, this La is the one obtained from the (110) diffraction of graphite by "Method for Measuring the Lattice Constant and the Size of Crystallites of an Artificial Graphite" (Sugiro Otani et al., Carbon Fibers, compiled by Kindai (1983) p. 701–710) stipulated by the 117th Committee Meeting of Nippon Gakujutsu Shinkokai. This method is a common method used for measurement of La. In this method, it is prescribed that when the measured La exceeds 1,000Å, all such cases will be evaluated as "more than 1,000Å". When the carbon fiber of the present invention is graphitized at a temperature of 3,000° C., La exceeds 1,000Å to a large extent and shows a value of a few thousands Å. Such a value is expressed simply as "more than 1,000Å" in this specification.

Now, the present invention will be described in further detail with reference to Examples. However, it should be understood that the present invention is by no means restricted to such specific Examples.

In the Examples, the spread La of the graphite crystallites in the layer plane direction was obtained from the (110) diffraction of graphite by "Method for Measuring the Lattice Constant and the Size of Crystallites of an Artificial Graphite" (Sugiro Otani et al., Carbon fibers, compiled by Kindai (1983) p. 701–710) stipulated by the 117th Committee Meeting of Nippon Gakujutsu Shinkokai, and presented as La (110).

With respect to the electrical specific resistance, the electrical specific resistance of monofilaments or a tow composed of about 4,000 fibers, was measured in accordance with Carbon Fiber Society Standard JCFS002- 1981 (Sugiro Otani et al., Carbon Fibers, compiled by Kindai (1983) p. 657–660).

With respect to the thermal conductivity, the carbon fiber was formed into a disk-shaped monoaxially carbon fiber-reinforced plastic having a diameter of 10 mm and a thickness of from 3 to 6 mm, and the specific heat and the thermal diffusibility of the CFRP were measured by heat constant measuring apparatus TC-3000 by laser flash method, manufactured by Shinku Riko K.K., and the thermal conductivity was calculated by the following formula:

$$K=Co\cdot a\cdot \rho/Vf$$

where K is the thermal conductivity of the carbon fiber, Cp is the specific heat of CFRP, $\alpha$ is the thermal diffusibility of CFRP, $\rho$ is the density of CFRP, and Vf represents the volume fraction of the carbon fiber contained in CFRP.

Figure 2:
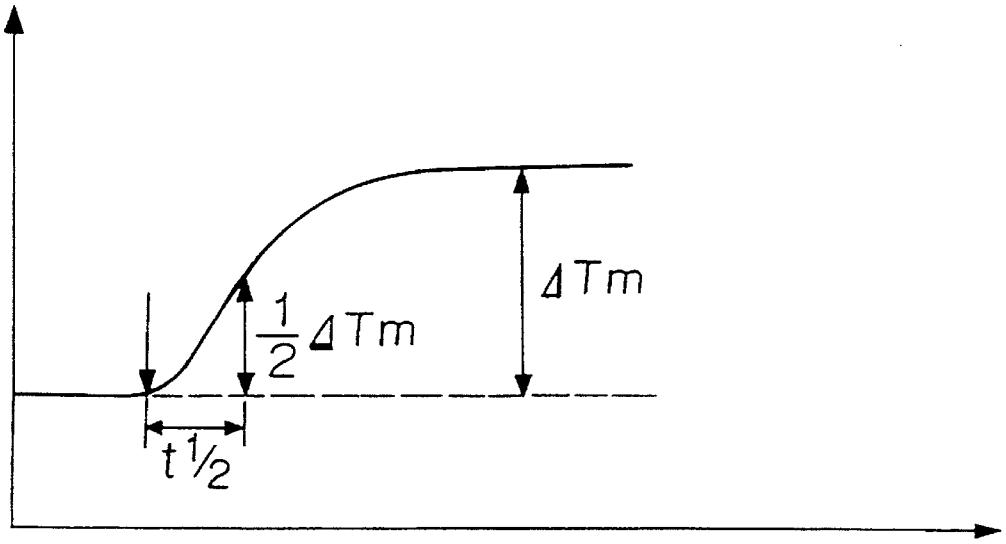
FIG. 2 is a graph showing the relation between the time passed after irradiation with a laser and the temperature at the rear side of the sample, when in the Examples of the present invention, the thermal conductivity was determined by means of thermal constant measuring apparatus TC-3000 by laser flash method, manufactured by Shinku Riko K.K.

The thickness of CFRP was changed depending upon the thermal conductivity of the carbon fiber. Namely, a sample having high thermal conductivity was made thick, and a sample having low thermal conductivity was made thin. Specifically, after irradiation with a laser, it takes a few tens seconds until the temperature at the rear side of the sample increases and reaches the maximum temperature. Here, the thickness of CFRP was adjusted so that the time t½ until the temperature rises by ½ of the temperature rising width ΔTm, is at least 10 msec (the maximum: 15 msec) (see FIG. 2).

The specific heat was obtained by bonding glassy carbon as a light receptor on the front side of the sample and measuring the temperature rise after irradiation with a laser by a R thermocouple bonded at the center of the rear side of the sample. The measured value was corrected using sapphire as a standard specimen.

The thermal diffusibility was determined by applying carbon spray to both sides of a sample to form a film until the surface was just invisible, and measuring the temperature change of the rear side of the sample after irradiation with a laser, by an infrared ray detector.

Further, the thermal conductivity of the carbon fiber can also be calculated from the electrical conductivity by utilizing the very good interrelation between the thermal conductivity and the electrical conductivity of the carbon fiber.

EXAMPLE 1

From coal tar pitch, an optically anisotropic pitch having a proportion of optical anisotropy of 100% as observed under a polarization microscope, was prepared.

This optically anisotropic pitch was spun by means of a nozzle having an introduction angle α=60°, L/D=5 a length M of the opening=1.73 mm, an outlet length L=0.5 mm and an outlet diameter D=0.1 mm, so that the viscosity of the pitch at the outlet was 120 poise, to obtain a pitch fiber having a fiber diameter of 12 μm.

This pitch fiber was heat-treated in air at 310° C. for 30 minutes to obtain an infusible fiber.

This infusible fiber was graphitized at 3,250° C. for 17 minutes in argon gas to obtain a carbon fiber.

This carbon fiber had a La (110) of at least 1,000Å, an electrical specific resistance of 1.07 μΩm and a thermal conductivity of 1,140 W/m·K.

EXAMPLE 2

From coal tar pitch, an optically anisotropic pitch having a proportion of optical anisotropy of 100% as observed under a polarization microscope, was prepared.

This optically anisotropic pitch was spun by means of the same nozzle as used in Example 1 so that the viscosity of the pitch at the outlet was 120 poise, to obtain a pitch fiber having a fiber diameter of 24 μm.

This pitch fiber was heat-treated in air at 250° C. for 240 minutes and then at 310° C. for 30 minutes to obtain an infusible fiber.

This infusible fiber was graphitized at 2,400° C. for 1 minute in argon gas to obtain a carbon fiber.

This carbon fiber had a La (110) of 400Å, an electrical specific resistance of 2.96 μΩm and a thermal conductivity of 380 W/m·K.

This carbon fiber was further baked at 3,000° C. for 60 minutes in argon gas, whereby the La (110) became at least 1,000Å, the electrical specific resistance became 1.07 μΩm and the thermal conductivity became 1,140 W/m·K.

EXAMPLE 3

From coal tar pitch, an optically anisotropic pitch having a proportion of optical anisotropy of 100% as observed under a polarization microscope, was prepared.

This optically anisotropic pitch was spun by means of the same nozzle as used in Example 1 so that the viscosity of the pitch at the outlet was 120 poise, to obtain a pitch fiber having a fiber diameter of 24 μm.

This pitch fiber was heat-treated in air at 250° C. for 240 minutes and then at 310° C. for 30 minutes to obtain an infusible fiber.

This infusible fiber was graphitized at 3,250° C. for 17 minutes in argon gas to obtain a carbon fiber.

This carbon fiber had a La (110) of at least 1,000Å, an electrical specific resistance of 0.99 μΩm and a thermal conductivity of 1,250 W/m·K.

COMPARATIVE EXAMPLE

From coal tar pitch, an optically anisotropic pitch having a proportion of optical anisotropy of 100% as observed under a polarization microscope, was prepared.

This optically anisotropic pitch was spun by means of the a nozzle having an introduction angle=150°, L/D=0.5, a length M of the opening=0.577 mm, an outlet length L=0.05 mm and an outlet diameter D=0.1 mm, so that the viscosity of the pitch at the outlet was 3,010 poise, to obtain a pitch fiber having a fiber diameter of 24 μm.

This pitch fiber was heat-treated in air at 250° C. for 240 minutes and then at 310° C. for 30 minutes to obtain an infusible fiber.

This infusible fiber was graphitized at 3,250° C. for 17 minutes in argon gas to obtain a carbon fiber.

This carbon fiber had a La (110) of 640Å, an electrical specific resistance of 1.81 μΩm and a thermal conductivity of 650 W/m·K.

The carbon fiber of the present invention exhibits remarkably high electrical conductivity and thermal conductivity as compared with conventional carbon fibers carbonized or graphitized under the same conditions. Further, according to the process for producing a carbon fiber of the present invention, a carbon fiber having such high electrical conductivity and thermal conductivity can readily be produced. Thus, the present invention presents substantial industrial advantages.

We claim:

1. A process for producing a carbon fiber having a spread La of graphite crystallites in the layer plane direction thereof of more than 1000Å, an electrical specific resistance of less than 1.1 μΩm and a thermal conductivity of more than 1100 W/m·K at room temperature, which comprises:

spinning an optically anisotropic pitch at a temperature at which the viscosity of the optically anisotropic pitch is not higher than 150 poise, by means of a nozzle having an introduction angle of smaller than 70° and a ratio (L/D) of the outlet length L to the outlet diameter D of more than 4, thereby obtaining a pitch fiber; and subjecting the pitch fiber to an infusibilization treatment, followed by carbonization, or carbonization and graphitization.

* * * * *